US006923220B2

(12) United States Patent
Roelstraete

(10) Patent No.: US 6,923,220 B2
(45) Date of Patent: Aug. 2, 2005

(54) GRIPPER HOUSING

(75) Inventor: Kristof Roelstraete, Zwevegem (BE)

(73) Assignee: Picanol N.V., Leper (BE)

( * ) Notice: Subject to any disclaimer, the term of this patent is extended or adjusted under 35 U.S.C. 154(b) by 214 days.

(21) Appl. No.: 10/257,362

(22) PCT Filed: Apr. 6, 2001

(86) PCT No.: PCT/EP01/03931

§ 371 (c)(1),
(2), (4) Date: Oct. 16, 2002

(87) PCT Pub. No.: WO01/79596

PCT Pub. Date: Oct. 25, 2001

(65) Prior Publication Data

US 2003/0136460 A1 Jul. 24, 2003

(30) Foreign Application Priority Data

Apr. 17, 2000 (DE) ..... 100 18 939

(51) Int. Cl.[7] ..... D03D 47/20
(52) U.S. Cl. ..... 139/448
(58) Field of Search ..... 139/196.2, 443–448

(56) References Cited

U.S. PATENT DOCUMENTS

| | | | | |
|---|---|---|---|---|
| 3,081,796 A | | 3/1963 | Remington | |
| 3,192,698 A | * | 7/1965 | Vibber | 57/58.83 |
| 3,296,788 A | * | 1/1967 | Gustav | 57/58.83 |
| 4,807,670 A | * | 2/1989 | Egloff et al. | 139/448 |
| 5,129,431 A | * | 7/1992 | Stacher | 139/448 |

FOREIGN PATENT DOCUMENTS

| | | |
|---|---|---|
| DE | 1256169 | 3/1961 |
| DE | 3136615 C2 | 4/1982 |
| DE | 9202068.2 | 5/1992 |
| EP | 0812938 A1 | 12/1997 |
| EP | 0893524 A1 | 1/1999 |
| WO | 99/18274 | 4/1999 |

* cited by examiner

*Primary Examiner*—John J. Calvert
*Assistant Examiner*—Andrew W. Sutton
(74) *Attorney, Agent, or Firm*—Bacon & Thomas, PLLC

(57) ABSTRACT

A weaving machine gripper housing, includes edges made of a sheetmetal forming the housing and includes edge yarn guide elements at the edges which have a thickness larger than the adjacent sheetmetal thickness. The thicker edge guide elements protect yarn engaging the edges during gripper use.

7 Claims, 3 Drawing Sheets

GRIPPER HOUSING

BACKGROUND OF THE INVENTION

1. Field of the Invention

The present invention relates to a gripper housing for a weaving-machine gripper, in particular for a drawing gripper consisting of one or more metal plates, some edge of which constitutes at least in part yarn guide elements.

2. Related Art

In order to weave at high rates, a gripper should be as lightweight as possible. For that purpose the gripper dimensions are made smaller. However, despite minimum sizes being mandatory, there are limits to such reduction in size.

Such gripper housings illustratively are known from the patent document WO 99/18274 and comprise a basic frame in the form of one or more pieces of bent sheetmetal, in particular steel sheetmetal. In order to attain further weight reduction, the thickness of the sheetmetal is reduced. Even though thicknesses of 0.3 to 0.5 mm might be feasible with respect to mechanical strength, practice dictates larger thickness. The edges of such thin sheetmetal act as blades or knives that immediately sever yarns the moment they touch them, in particular fillings which are inserted into a yarn clamp with the gripper-housing edges acting as guide elements and which then hold them in readiness in a specific way.

The objective of the present invention is to design a gripper housing of the above kind in such a manner that its weight may be reduced further.

SUMMARY OF THE INVENTION

This problem is solved in that at least a part of the edges of sheetmetal constituting the guide elements have a width (i.e., thickness dimension) larger than the thickness of the adjacent sheetmetal.

On account of this design, the gripper housing may consist of thin sheetmetal of adequate mechanical strength for its purpose. Because the edges acting as guide elements are wider (thicker) than the thickness of the sheetmetal, the danger of cutting yarns and in particular of cutting fillings is substantially averted.

In one advantageous embodiment of the present invention, the sheetmetal edges are bent back. As a result the sheetmetal edges are widened in a simple manner and this widening leads to further advantages. Said back-bending results in a guide element surface requiring no further processing while enabling gentle handling of the yarns. Because of bending back, the actual edges of the stamped or cut sheetmetal are recessed and consequently do not touch the yarns. Therefore they need not be processed. Moreover, the back bending of the edges reinforces the sheetmetal and, where appropriate, the sheetmetal thickness may be reduced further.

Advantageously the guide element-constituting edges are bent back at a radius of curvature larger than the sheetmetal thickness. As a result, comparatively large radii are subtended at these edges to deflect the yarns, and in particular the fillings held by the gripper.

In another embodiment, the sheetmetal edges constituting the guide elements are thickened or widened by fittings. Such fittings may be in the form of a rod or tube that also allow both widening and strengthening the sheetmetal. They are affixed by welding or soldering. Where called for, bonding also may be used. Such fittings also offer the advantage of eliminating the need to process the sheetmetal edges after stamping or cutting.

In another embodiment, material is removed from the sheetmetal on one or both their sides except for the edges acting as guide elements. Illustratively such removal may be carried out by etching. However material also may be removed from the sheetmetal mechanically, for instance by planing or milling, before they are shaped into a gripper housing. With this latter approach, however, the sheetmetal edges that constitute yarn guide elements will need to be processed, that is, they must then be ground and polished.

DESCRIPTION OF THE DRAWINGS

Further features and advantages of the present invention are described in the following description of the illustrative embodiments shown in the drawings.

DETAILED DESCRIPTION

Figure 1:
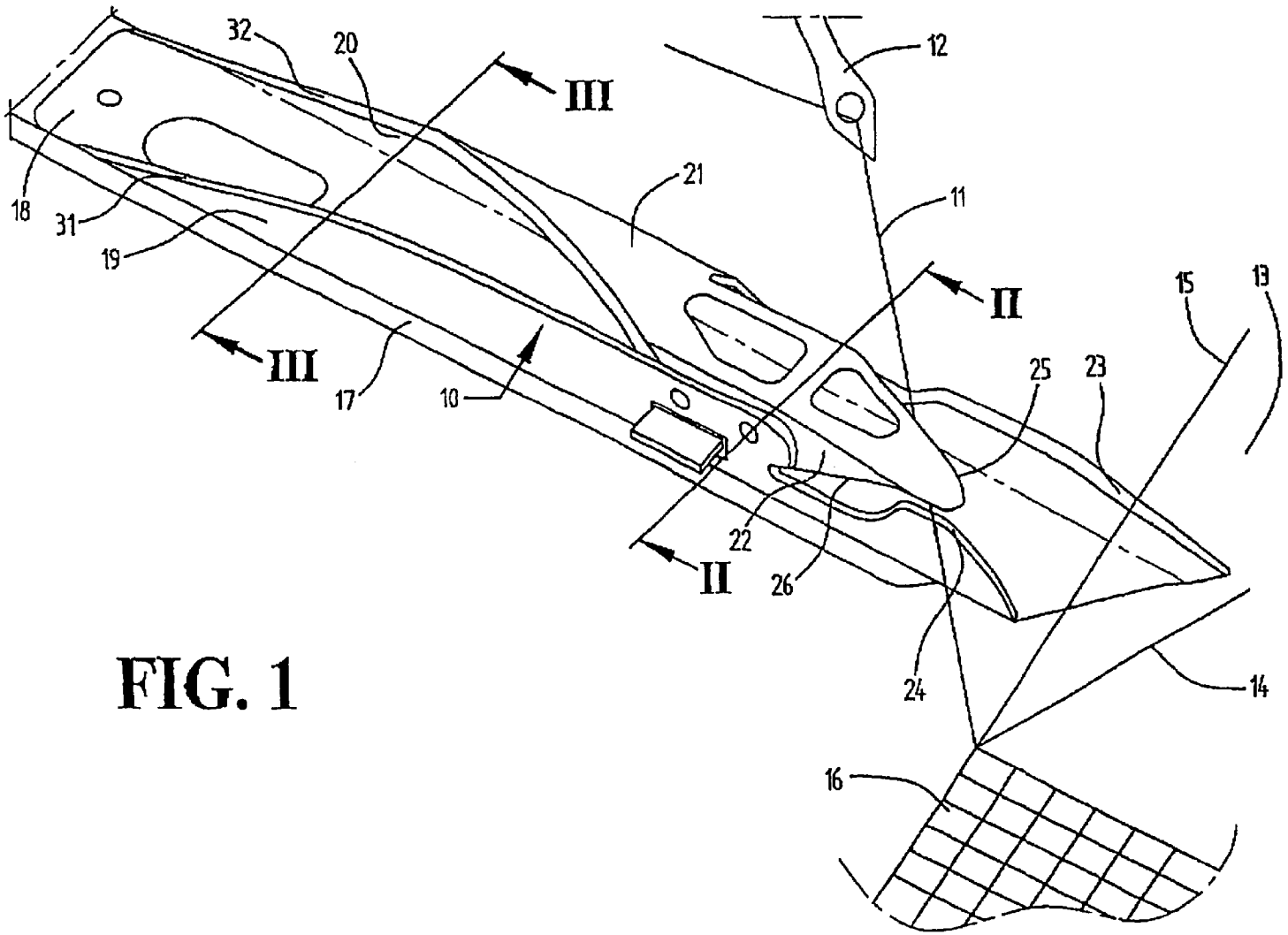
FIG. 1 is perspective view of a drawing gripper fitted with a gripper housing according to the invention.

The drawing gripper 10 shown in FIG. 1 receives a filling 11 kept ready by a feeder element 12 and moves it into a shed 13. The shed 13 is constituted of warps 14, 15 that are raised and lowered. As soon as the drawing gripper 10 has picked up the filling, the latter is severed from the fabric 16. After the filling 11 has been inserted into the shed 13, it will be beaten against the beat-up edge of the fabric 16. Typically the drawing gripper 10 moves the filling into the approximate center of the shed 13. There the filling 11 is accepted by a receiving gripper (not shown) and moved by it to the opposite side. The drawing gripper 10 is affixed to a gripper tape 17 which, by means of a drive that is not shown, and together with the drawing gripper 10, is moved into the shed 13 and then retracted from it.

The drawing gripper 10 comprises a basic structure consisting of sheetmetal, in particular steel sheetmetal, that is formed into a substantially tubular housing. The cross-section of the drawing gripper 10 is predominantly U-shaped. A transverse segment 18 rests on the top side of the gripper tape 17 to which it is affixed by not-illustrated screws. Two sidewalls 19, 20 project upward from this transverse segment 18. A portion 21 at the top of sidewall 20 is bent toward the center and in turn adjoins an inwardly bent portion 22 extending toward the inside of the gripper housing.

After the drawing gripper 10 enroute to the shed 13 receives the filling 11 that was kept ready for it at the feeder element 12, the said filling is moved into a specified position by guide elements 23, 24, 25, 26. These guide elements 23, 24, 25, 26 are defined by the edges of the sheetmetal constituting the base structure or gripper housing of the drawing gripper. The guide elements 23, 24 are defined by front, upper edges of the side walls 19, 20. The guide elements 25, 26 are defined by the edges of the portion 21, 22. The filling 11 is guided in such a way by said guide elements that, within the gripper housing, it shall run substantially diagonally and obliquely downward (starting from the drawing gripper's side wall 19 facing the fabric 16). In the process, the filling 11 also moves into a yarn clamp 27, so that, after being cut from the filling previously inserted and thus already belonging to the fabric 16, the filling is securely held in the drawing gripper 10.

The yarn clamp 27 includes a stationary clamping element 28 and a displaceable clamping element 29 that between them receive the filling 11. The stationary clamping element 28 is affixed by screws 30 to the side wall 19 of the drawing gripper. From the above, it follows that the drawing gripper 10 corresponds substantially to that of WO 99/18274 and therefore description of its design and operation may be found in that document.

In order to attain high weaving rates, the change of shed of modern weaving machines is begun before the drawing gripper 10 has been fully retracted from the shed. Accordingly the drawing gripper 10 must be designed in such manner that no warps may snag on it—which then would rupture. Accordingly guide elements 31, 32 are provided at the front end of the drawing gripper 10 which where called for shall deflect warps in such a way that the drawing gripper 10 together with the region of the yarn clamp 27 may cross underneath. These guide elements 31, 32 are constituted by the upper edges of the sidewalls 19, 20 and by the edge of the element 21 adjoining the side wall 20.

Figure 2:
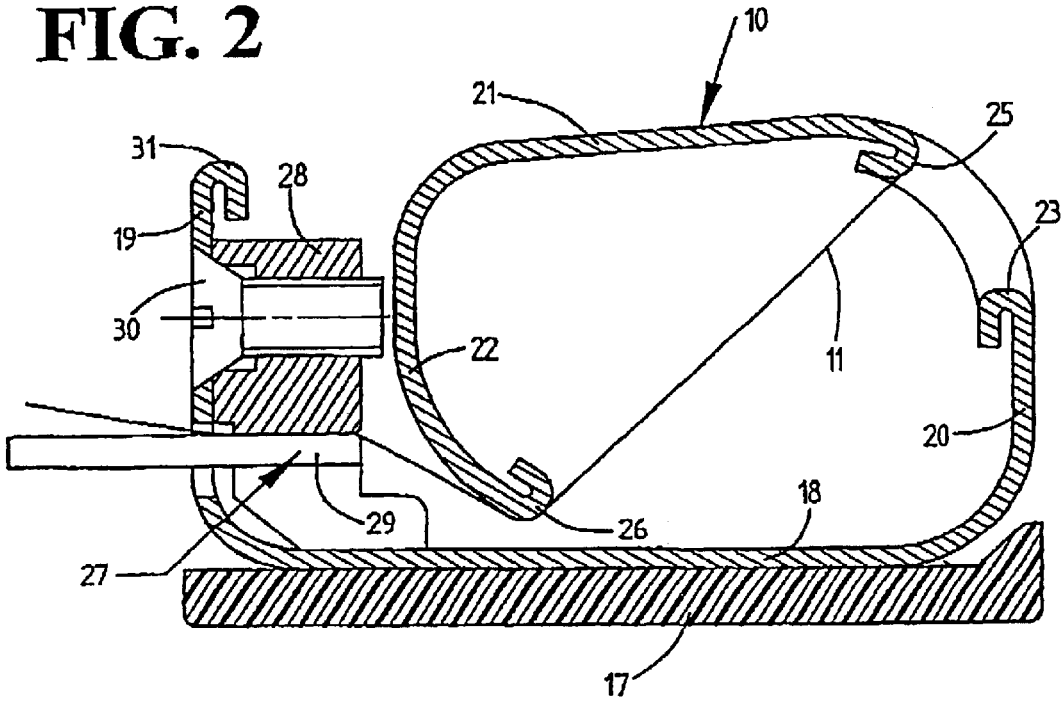
FIG. 2 is a section along line II—II of FIG. 1.
Figure 3:
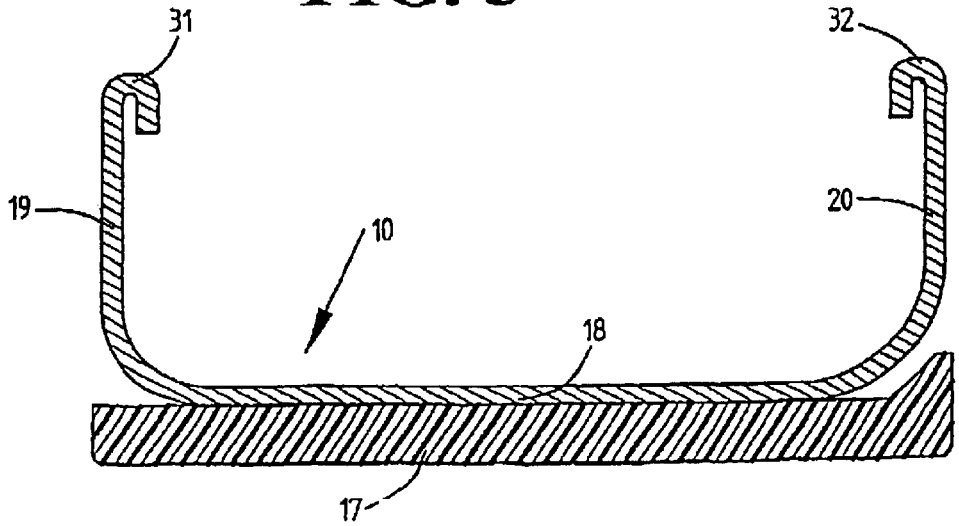
FIG. 3 is a section along line III—III of FIG. 1.

The edges of the drawing gripper housing's sheetmetal constituting the guide elements 23, 24, 25, 26, 31, 32 each are bent over inwardly in order to subtend a kind of fold. As shown by FIGS. 2 and 3, the bending is carried out observing a radius of bending. This radius of bending is somewhat larger than the thickness of the sheetmetal and as a result the guide elements 23 through 26, 31, 32 constitute fillings-and-warps rest surfaces which are substantially wider (thicker) than the sheetmetal thickness. On account of this design, the sheetmetal thickness may be kept very low, whereas the guide elements 23 through 26, 31, 32 will have adequate width (thickness) and will not act as blades or knives against yams moving over them. Moreover the folded feature of the edges offers the advantage of subtending a substantially round or partly cylindrical guide element surface which is very appropriate to guide yarns. Foremost it offers the advantage that the initial sheetmetal edges formed by stamping or cutting need not be processed, or at least not precisely, because these edges do not come into contact with a yarn. The folding or flanging of the edges also entails enhanced mechanical strength and in some instances because of this enhancement the sheetmetal thickness may be reduced still further and thereby weight saving may be further improved.

Figure 4:
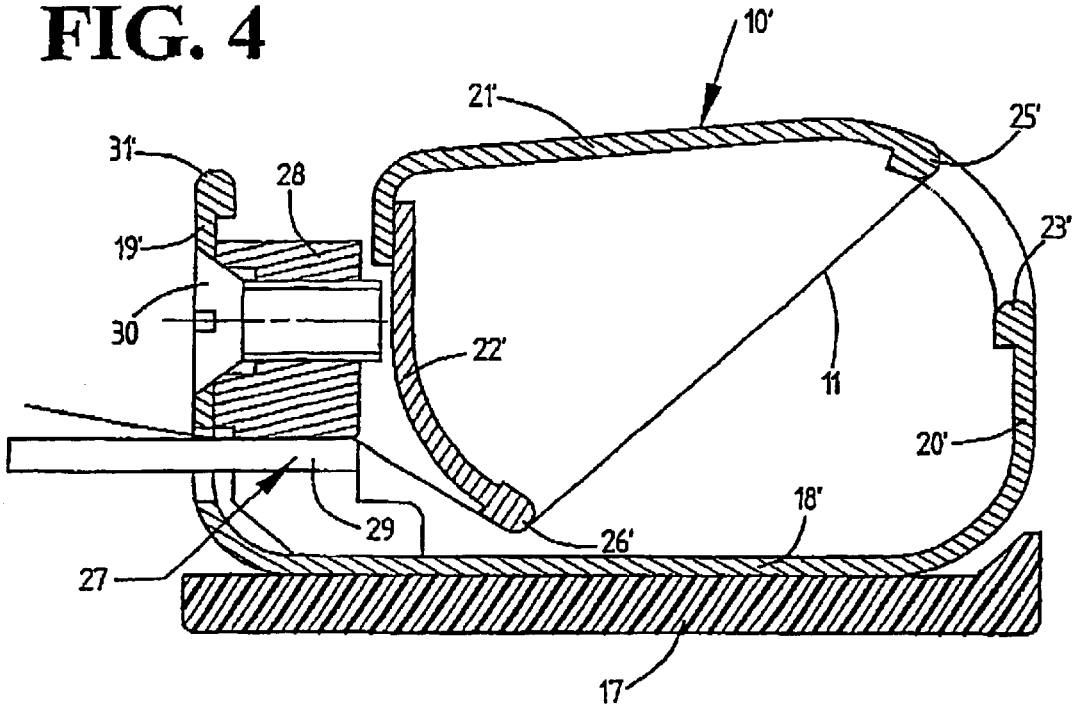
FIG. 4 is a section similar to that of FIG. 2 of another illustrative embodiment of a drawing gripper.

In principle, the drawing gripper 10' of FIG. 4 is the same in design as the drawing gripper 10 of FIGS. 1 through 3 and accordingly reference is made to the latter for its description. A first difference is that the portion 22' is not integral with the sheetmetal comprising the typical wall segments, but instead it is a separate sheetmetal portion that, by means of a portion 21' comprising a bent attachment, is connected to the latter by a weld. In this embodiment the guide elements 23', 25', 26', 31' (furthermore the guide elements not visible in FIG. 4) have a width (or thickness) larger than the thickness of the sheetmetal constituting the gripper housing. For that purpose the transverse segment 18', the side walls 19', 20' and the sheetmetal constituting the portion 21' are etched to remove material from it. No material is removed in the areas of the guide elements 23', 25', 31' and therefore the edges that constitute these guide elements retain their initial widths thereby constituting enlarged thickness edge portions formed integrally in one piece with the adjacent sheet metal walls 19', 20'. Furthermore said edges are processed on their outside, in particular by grinding and/or buffing to produce a smooth, rounded surface.

The sheetmetal constituting the portion 22' was processed by etching both sides as far as the edge forming the guide element 26', as a result of which the sheetmetal's thickness has been reduced compared to the edge constituting said guide element 26'. Moreover the edge constituting this guide element 26' was subsequently processed by grinding and/or buffing in order to provide it with a smooth, round surface. As regards another variation of this embodiment, the sheetmetal 22' is replaced by sheetmetal the thickness of which throughout is that of the guide element 26'. In still another variation, the segment 19' is the same thickness everywhere as that of the guide element 31'. Under such circumstances, the increased thickness of this segment advantageously absorbs the forces imposed against the yarn clamp 27.

Figure 5:
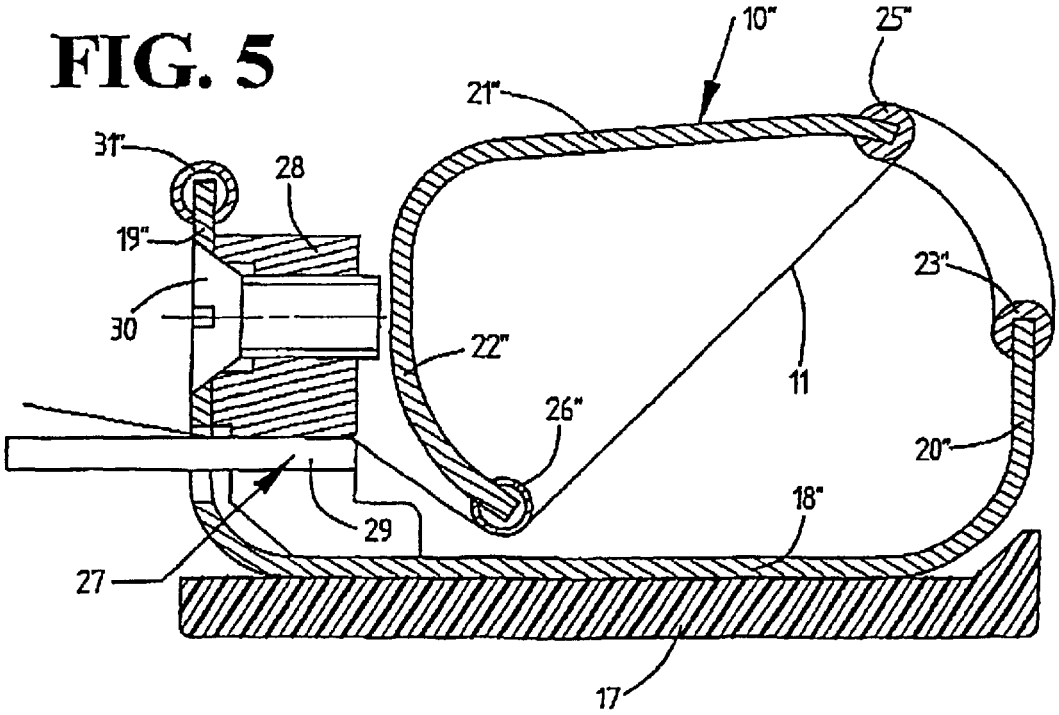
FIG. 5 is a section similar to that of FIG. 2 of another illustrative embodiment of a drawing gripper.

Again, the gripper housing of a receiving gripper 10" shown in FIG. 5 corresponds to the design of the illustrative embodiment of FIGS. 1 through 3, a discussion of which already was provided above. The sheetmetal edges constituting the guide elements 23", 25", 26", 31" (as well as the guide elements 24 and 323 which are not visible), are fitted with a fitting the width or thickness of which exceeds the thickness of the adjacent sheetmetal. In this design the guide elements 23" and 25" consist of a bent, cross-sectionally circular bar which is fitted with a longitudinal groove and fitted on the sheetmetal edge. As shown with respect to the guide elements 26" and 31", the width enlargement also may be attained by processing the edges in the vicinity of these guides such that said edges are received inside a slotted round tube. Preferably such fittings are made of a wear-resistant steel and preferably are welded to the sheetmetal.

Obviously the present invention is not restricted to the shown embodiments. The present invention in particular is applicable also to receiving grippers fitted with metal strips constituting guide elements. Furthermore the various designs resulting in guide elements which are wider than the sheetmetal thickness also may be combined, that is, the sheetmetal edges may be flanged or folded in the regions of a few guide elements while in the regions of others the edges may be fitted with width-enlarging fittings. Other designs of such fittings also are feasible, in particular the use of strips or the like that are welded inside or outside of said edges.

What is claimed is:

1. A gripper housing for a weaving-machine gripper comprising at least one sheetmetal piece wherein the sheetmetal of the piece has a thickness dimension and the sheetmetal piece includes at least one edge comprising at least in part a yarn-guiding element arranged to be contacted by a yarn to be carried by the gripper, and wherein said at least one edge has a thickness dimension exceeding the thickness of the sheetmetal adjacent the yarn guiding element.

2. Gripper housing as claimed in claim 1, wherein at least one edge comprising a yarn guiding element is defined by a folded back portion of sheetmetal forming the sheetmetal piece.

3. Gripper housing as claimed in claim 2, wherein the folded back portion is bent back at a radius of curvature which is larger than the thickness of the sheetmetal.

4. Gripper housing as claimed in claim 1, wherein at least one sheetmetal edge comprising a yarn guiding element includes a fitting providing said edge thickness dimension.

5. Gripper housing as claimed in claim 4, wherein the fitting comprises a rounded outside surface to be engaged by a yarn.

6. Gripper housing as claimed in claim 1, wherein said sheetmetal edge comprises an enlarged thickness edge portion formed integrally in a single piece with said sheetmetal adjacent said yarn guiding element.

7. Gripper housing as claimed in claim 1, said at least one sheet metal piece includes a plurality of edges comprising a plurality of yarn guiding elements, and wherein each yarn guiding element is defined by an edge of the sheet metal having a thickness dimension exceeding the thickness dimension of the sheet metal of forming the sheet material piece.

* * * * *